US008894391B2

(12) United States Patent
Wolff

(10) Patent No.: US 8,894,391 B2
(45) Date of Patent: Nov. 25, 2014

(54) LINEAR PERISTALTIC PUMP WITH FINGERS AND MEMBRANE AND FINGER FOR SUCH A PUMP

(75) Inventor: Remy Wolff, Morette (FR)

(73) Assignee: Fresenius Vial SAS, Brézins (FR)

( * ) Notice: Subject to any disclaimer, the term of this patent is extended or adjusted under 35 U.S.C. 154(b) by 693 days.

(21) Appl. No.: 12/679,425

(22) PCT Filed: Sep. 16, 2008

(86) PCT No.: PCT/EP2008/062268

§ 371 (c)(1),
(2), (4) Date: Jun. 16, 2010

(87) PCT Pub. No.: WO2009/037234

PCT Pub. Date: Mar. 26, 2009

(65) Prior Publication Data

US 2010/0296955 A1 Nov. 25, 2010

(30) Foreign Application Priority Data

Sep. 20, 2007 (FR) ..... 07 57689

(51) Int. Cl.

| | |
|---|---|
| ***F04B 43/08*** | (2006.01) |
| ***F04B 43/12*** | (2006.01) |
| ***F01B 19/04*** | (2006.01) |
| ***F04B 43/02*** | (2006.01) |

(52) U.S. Cl.

CPC ..... *F04B 43/082* (2013.01); *F04B 43/021* (2013.01)

USPC ..... 417/477.1; 92/99; 92/103 R; 417/477.12

(58) Field of Classification Search

CPC ..... F04B 43/0072; F04B 43/082; A61M 5/14228

USPC ..... 417/413.1, 477.1, 477.3, 474, 479, 417/477.12; 604/153; 92/99, 103 F, 103 R

See application file for complete search history.

(56) References Cited

U.S. PATENT DOCUMENTS 4,302,164 A * 11/1981 Manella ..... 417/474
4,382,753 A * 5/1983 Archibald ..... 417/479

(Continued)

FOREIGN PATENT DOCUMENTS

DE 3202251 A1 8/1983
EP 0225158 A2 6/1987

(Continued)

OTHER PUBLICATIONS

International Search Report of PCT/EP2008/062268, mailing date of Nov. 3, 2008.

*Primary Examiner* — Alexander Comley
(74) *Attorney, Agent, or Firm* — Westerman, Hattori, Daniels & Adrian, LLP

(57) ABSTRACT

A linear peristaltic pump with fingers includes a membrane positioned between the pumping fingers (250) and the tube. A part of the membrane against which the fingers (250) press, which part is called the track (212), is kept in permanent contact with the end of the fingers (250) throughout the duration of the pumping cycle, even in the absence of any tube. This material will be more rigid than the rubber conventionally used but, by virtue of the permanent contact, the track will not remain pressed against the tube but will, by contrast, be lifted by the finger (250). It will thus be possible to select a stronger material that will suffer less wear for the track. The precision of the pump will be guaranteed for longer and membrane changes that are painstaking and costly in terms of time and in terms of labor will be avoided.

27 Claims, 4 Drawing Sheets

(56) References Cited

U.S. PATENT DOCUMENTS

Figure 1:
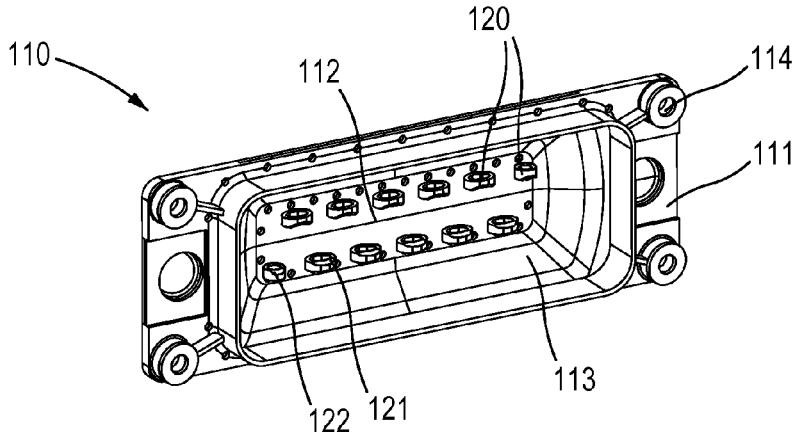

| | | | | | |
|---|---|---|---|---|---|
| 4,519,298 | A | * | 5/1985 | Sumner | 92/103 F |
| 4,671,792 | A | * | 6/1987 | Borsanyi | 604/153 |
| 4,690,673 | A | * | 9/1987 | Bloomquist | 604/67 |
| 4,755,109 | A | * | 7/1988 | Botts | 417/360 |
| 4,836,752 | A | * | 6/1989 | Burkett | 417/12 |
| 4,909,710 | A | * | 3/1990 | Kaplan et al. | 417/53 |
| 4,954,046 | A | * | 9/1990 | Irvin et al. | 417/53 |
| 5,002,471 | A | * | 3/1991 | Perlov | 417/413.1 |
| 5,281,108 | A | * | 1/1994 | Brooke | 417/395 |
| 5,318,413 | A | * | 6/1994 | Bertoncini | 417/475 |
| 5,413,252 | A | * | 5/1995 | Magnus | 222/129.1 |
| 5,549,460 | A | * | 8/1996 | O'Leary | 417/474 |
| 5,888,052 | A | * | 3/1999 | Hill | 417/53 |
| 5,964,583 | A | * | 10/1999 | Danby | 417/474 |
| 5,980,490 | A | * | 11/1999 | Tsoukalis | 604/151 |
| 6,086,340 | A | * | 7/2000 | Edwards et al. | 417/440 |
| 6,234,773 | B1 | * | 5/2001 | Hill et al. | 417/474 |
| 7,217,108 | B2 | * | 5/2007 | Herwig et al. | 417/475 |
| 2001/0007636 | A1 | * | 7/2001 | Butterfield | 417/477.1 |
| 2004/0037723 | A1 | * | 2/2004 | Herwig et al. | 417/474 |
| 2006/0039806 | A1 | * | 2/2006 | Becker | 417/413.1 |
| 2006/0110274 | A1 | * | 5/2006 | Gottschalk | 417/477.6 |

FOREIGN PATENT DOCUMENTS

| | | | |
|---|---|---|---|
| EP | 0431726 | A2 | 6/1991 |
| GB | 2179404 | A | 3/1987 |

* cited by examiner

LINEAR PERISTALTIC PUMP WITH FINGERS AND MEMBRANE AND FINGER FOR SUCH A PUMP

The invention relates to a linear peristaltic pump with fingers, comprising a membrane placed between the pumping fingers and the tubing, as well as a membrane and fingers for a pump of this kind.

Peristaltic pumps are made up of a series of parallel fingers driven in a vertical reciprocating movement. Each finger's movement is offset with respect to the preceding one in such a way that the ends of the fingers form a sine wave that moves in the direction of pumping. The ends of the fingers press down on a flexible tube placed between the fingers and a platen. The finger furthest down causes an occlusion, which migrates in the downstream direction of the pump from one finger to the next, ending with the last. When the last finger is in the occluding position, the first finger at least is once again in the occluding position, thereby causing the fluid in the tube to move.

In order to protect the pumping unit from external stresses, such as intrusion by foreign liquids or bodies, it is usual to place a flexible membrane, fixed to the pump housing, between the ends of the fingers and the flexible tube.

These membranes have two main disadvantages: wear and tear from the friction of the fingers and the effect their elasticity has on the tube as it returns to its normal shape.

The membrane is compressed between the pumping fingers and the counter bearing surface (generally the door, covered with a hard plastic material), just as the tubing is. It can often be seen that after multiple years of operation, the membranes are damaged in the area where they contact the fingers. This is due to fatigue of the material, which is subjected to repeated cycles of compression and friction (micro-movement) stresses. By contrast, no damage can be seen on the counter bearing surface. This shows that hard plastic materials are much more resistant to compression stresses than soft plastics. Over the useful life of the apparatus, it is common to change the membrane at least once. Clearly, the main problem is the cost of the part, but there is also the cost of labor (which can be relatively high depending on the way the membrane is assembled and whether the pump must be recalibrated after this sort of replacement). As the membrane wears, a decrease in the precision of the pump is observed, which can be a major disadvantage for peristaltic pumps intended for medical use.

In addition, the tubing is successively compressed and released during pumping. During the phase in which the tube is not compressed, it must return to its initial cylindrical shape in order to be able to make the liquid circulate. In returning to its initial shape, the tube is generally aided by its own elasticity, first, and also by the pressure of the fluid upstream of the pump (which corresponds to the height of the liquid). However, the flexible membrane itself, which is normally flat, hinders the tube from returning to its shape. That is, in order to return to its original shape, the tube must push on and deform the membrane. This phenomenon is observable after long periods of pumping: the elasticity of the tube has deteriorated, and a decrease in its elastic properties is observed.

The objective of the invention is thus to develop a membrane a) that is more resistant to wear from the friction of the fingers on one of its faces, and b) that does not press on the tube so as to not hinder it when it returns to its normal cylindrical shape.

This objective is achieved according to the invention in that means are provided to keep the part of the membrane on which the fingers press, called the "track", in permanent contact with the ends of the fingers during the entire pumping cycle, even in the absence of any tubing. This way, a more resistant material can be chosen for the part known as the track. This material will be more rigid than the rubber normally used, but by using the means for maintaining contact, the track will not remain pressed against the tube, but instead will be raised by the finger. This way, a more resistant material can be chosen that will suffer less wear. The precision of the pump will be ensured for longer, and membrane changes that are painstaking and costly in time and labor will be avoided.

Preferably, the means for putting the track in permanent contact with the ends of the fingers consist of means for mechanically coupling the track to the end of at least one finger. Of course, it is possible to mechanically couple the track with the ends of all the fingers. However, it may suffice to couple it only to the ends of certain fingers, in particular, the end of a single finger, e.g., one of the middle fingers.

In order to allow a non-elastic material to be used, the means for putting the track in permanent contact with the ends of fingers that have two neighbors will preferably have a degree of freedom parallel to the pumping direction, so that during a pumping cycle, the track can have reciprocating translational movement, substantially parallel to the pumping direction, with respect to the ends of said fingers.

In order to keep the track from migrating along with the liquid in response to the pumping action of the fingers, it is preferable to provide the pump with means for blocking the overall movement of the track in the direction of flow.

In practice, in the part where the fingers press during operation, known as the track, the membrane can be equipped with means for mechanically coupling the track to the end of at least one finger, which coupling means constitute part of the means for keeping the ends of the fingers in permanent contact with the track.

Preferably, at least the means for mechanically coupling the track to the ends of fingers that have two neighbors will have a degree of freedom parallel to the pumping direction, so that during a pumping cycle, the track can have reciprocating translational movement, substantially parallel to the pumping direction, with respect to the ends of said fingers. By adjusting its geometry and/or its material, one can have a track that is flexible without being elastic. The track can thus be made of a flexible, but non-elastic material.

The membrane is preferably made of a rigid frame equipped with means for fixing the membrane inside the pump, the track, and an intermediate flexible membrane connecting the track to the frame in such a way that the membrane forms a continuous, impermeable surface, with said intermediate membrane being preferably overmolded on the frame and the track. Because of the flexible intermediate membrane, the track can move, not just to follow the reciprocating movements of the fingers, but also in the direction of flow, moving relative to the ends of the fingers. The selection of a more resistant material for the track is compensated for by the flexibility of the intermediate membrane.

In order to ensure that there is enough room to allow the track to move in all three spatial directions while keeping the intermediate membrane from being stretched, provision is made to proportion the latter so as to push the track in the opposite direction from the coupling means in the absence of any pressure, particularly from the pumping fingers.

In a first embodiment, the coupling means consist of mushroom-shaped elements engageable in slots extending in the direction of pumping, and placed in the end of one or more pumping fingers.

In a second embodiment, the coupling means consist of rings placed on the track parallel to the direction of pumping, into which pins on the end of one or more pumping fingers can fit, the rings that must cooperate with fingers that have two neighboring fingers being preferably oblong, with their long axis parallel to the direction of pumping, and/or the rings that must cooperate with the upstream and downstream fingers being preferably circular.

In both cases, even though the track is fastened to the ends of the fingers, it can have motion relative to them, motion that is substantially parallel to the direction of flow. This makes it possible to compensate for the differences in distance between the ends of two successive fingers as the pumping cycle progresses. Depending on the embodiment, one can distinguish between the upstream and downstream fingers, and the in-between fingers characterized by the presence of two neighboring fingers.

In order to keep the track from migrating along with the liquid in response to the pumping action of the fingers, it is preferable to provide on the track means for blocking the overall movement of the track in the direction of flow.

In the second embodiment, this is achieved by selecting circular rings for the upstream and downstream fingers. This way, the track is blocked in longitudinal translation with respect to the upstream and downstream fingers. Another solution is to place a center tab between two successive coupling means, perpendicular to the direction of pumping, preferably in the middle of the track.

To increase the resistance of the membrane, it is preferable to extend the track on both sides of the coupling means with two end tabs.

The invention also relates to pumping fingers for the peristaltic pump according to the invention. Such a finger can be equipped with means for cooperating with the membrane coupling means, the cooperating means constituting part of the means for maintaining permanent contact between the ends of the fingers and the track.

In a first embodiment, the cooperating means consist of a slot extending in the direction of pumping. In a second embodiment, the cooperating means consist of a pin extending perpendicular to the pumping plane.

Figure 2:
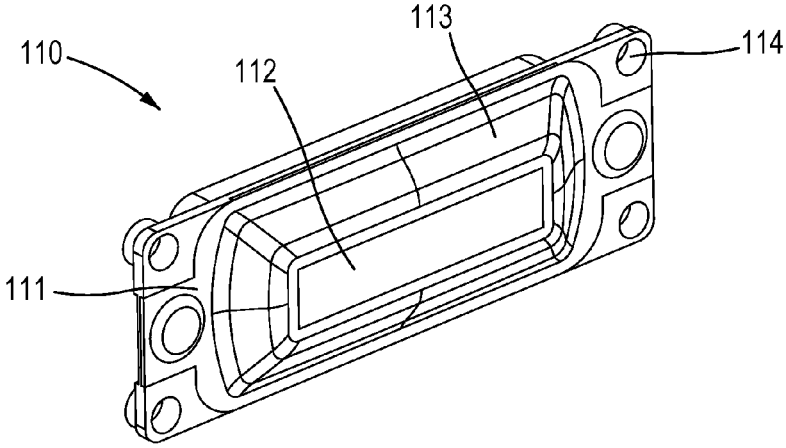
Figure 3:
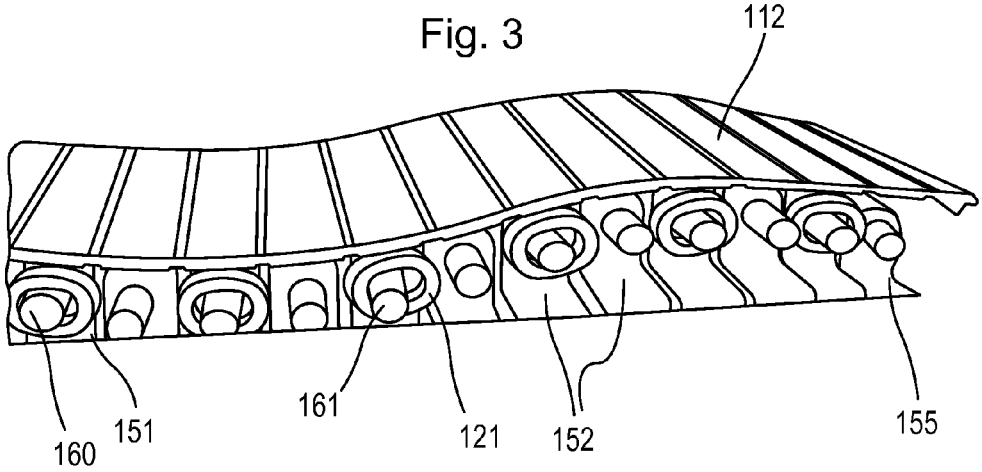
Figure 4:
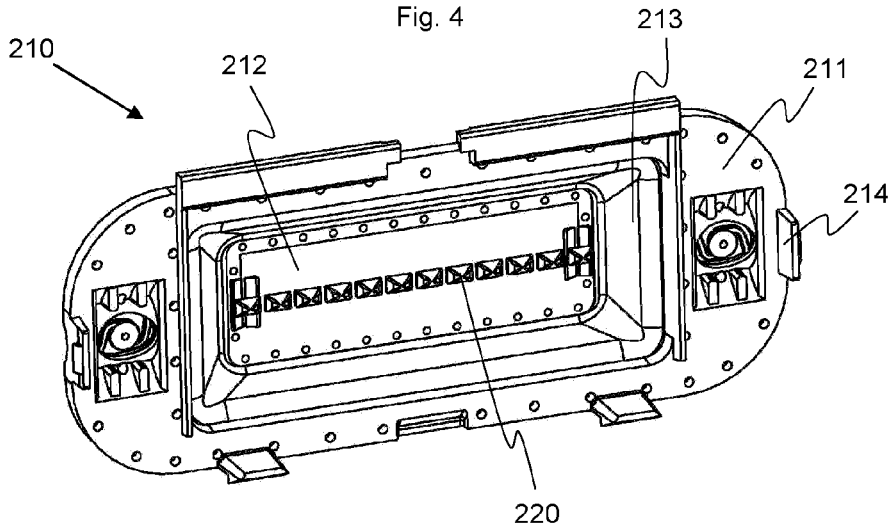
Figure 5:
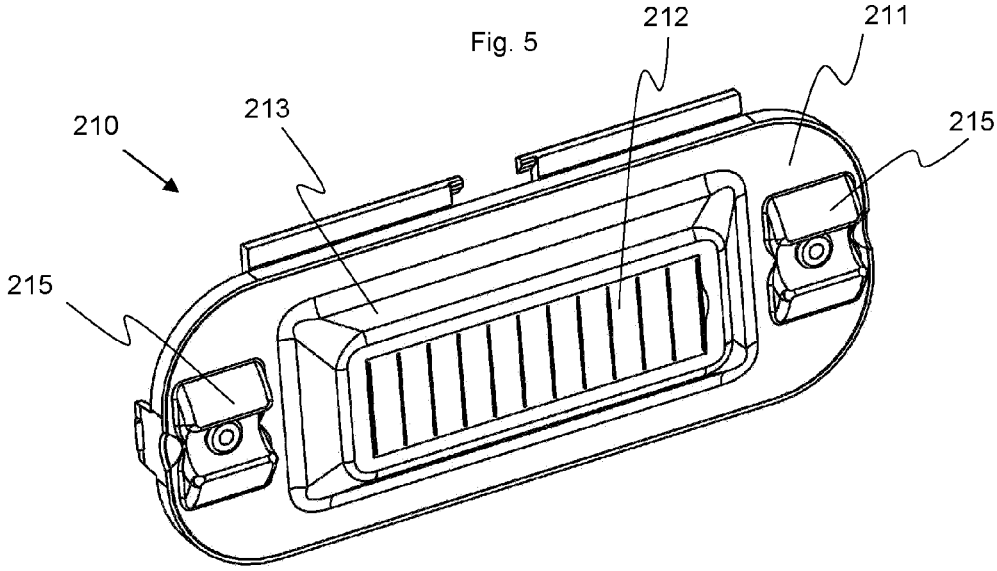
Figure 6A:
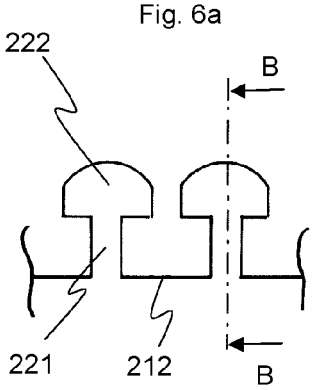
Figure 6B:
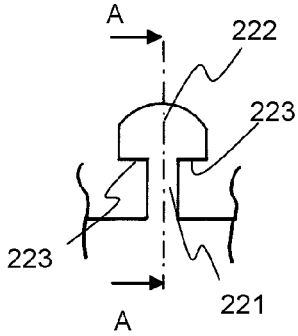
Figure 6C:
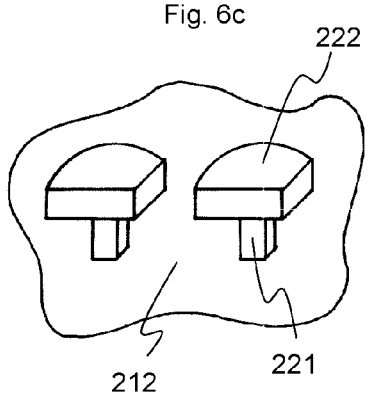
Figure 7:
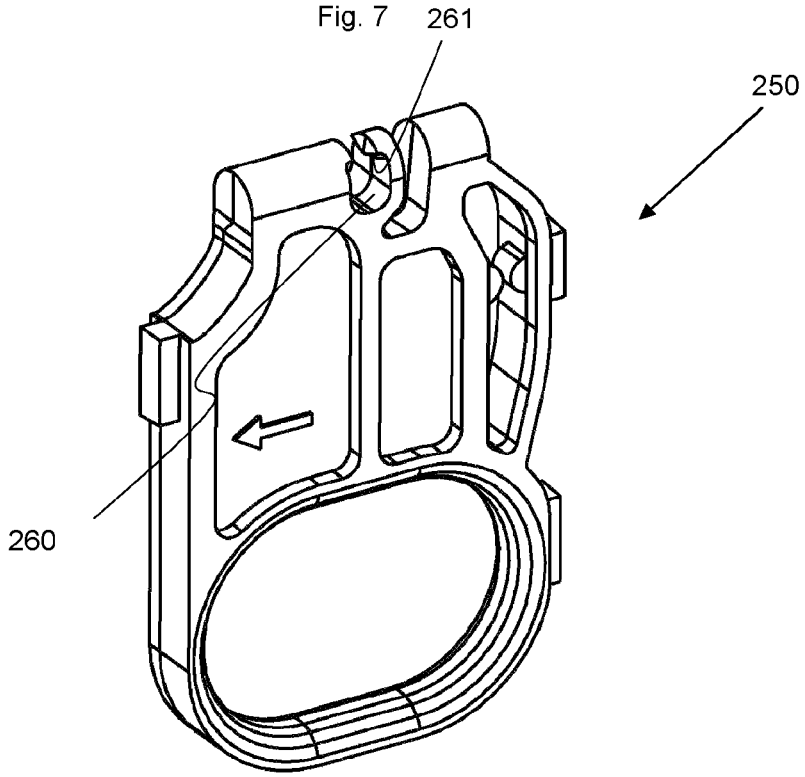
Figure 8:
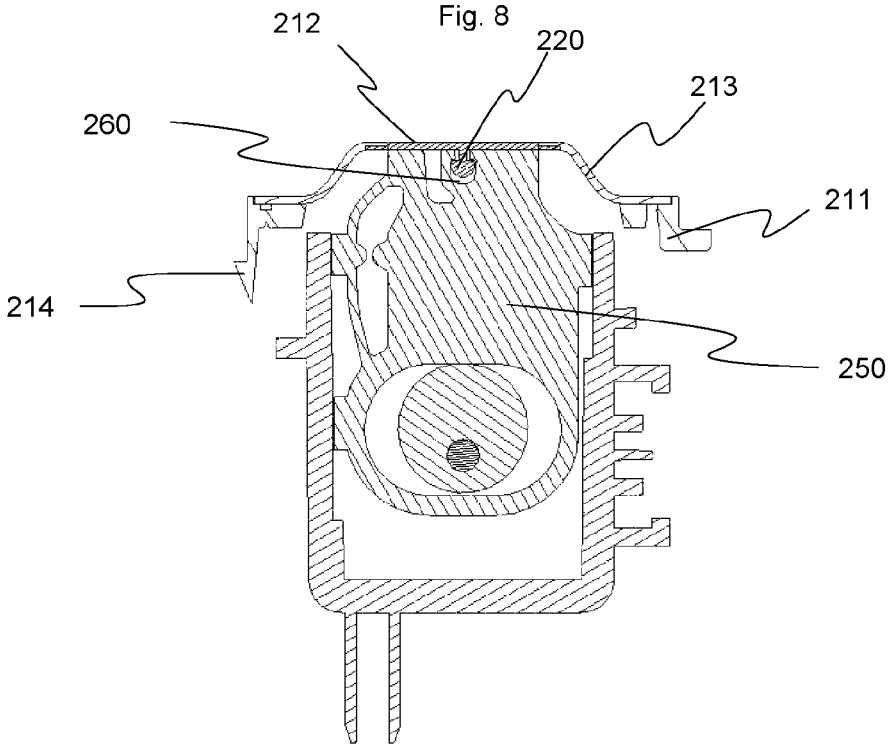
Figure 9:
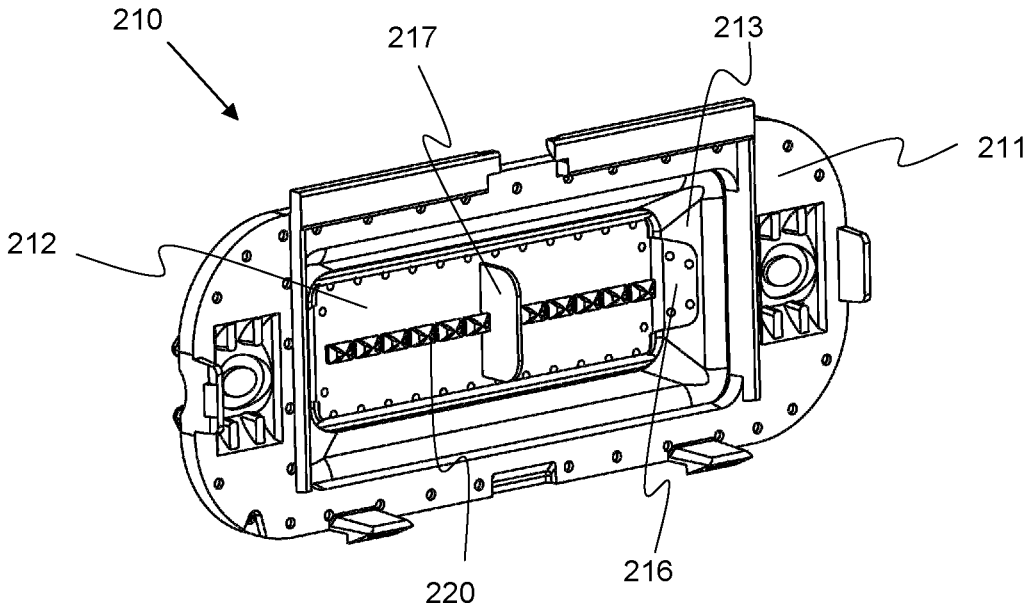

The invention is described below using two examples of embodiments presented in the figures, which show:

FIG. 1: a perspective view of a first embodiment of the membrane according to the invention, seen from the side with the coupling means;

FIG. 2: perspective view of the membrane in FIG. 1, seen from the side opposite the coupling means;

FIG. 3: perspective view of the track of the membrane in FIG. 1 mounted on top of the pump fingers;

FIG. 4: perspective view of a second embodiment of the membrane according to the invention, seen from the side with the coupling means;

FIG. 5: perspective view of the membrane in FIG. 4, seen from the side opposite the coupling means;

FIG. 6: enlarged view of the coupling means of the membrane in FIG. 4;

FIG. 7: perspective view of a finger equipped with means for cooperating with the coupling means of the membrane in FIG. 4;

FIG. 8: sectional view of the finger in FIG. 7, and of the membrane in FIG. 4 clipped thereupon;

FIG. 9: enlarged view of the membrane in FIG. 4.

Figure 10:
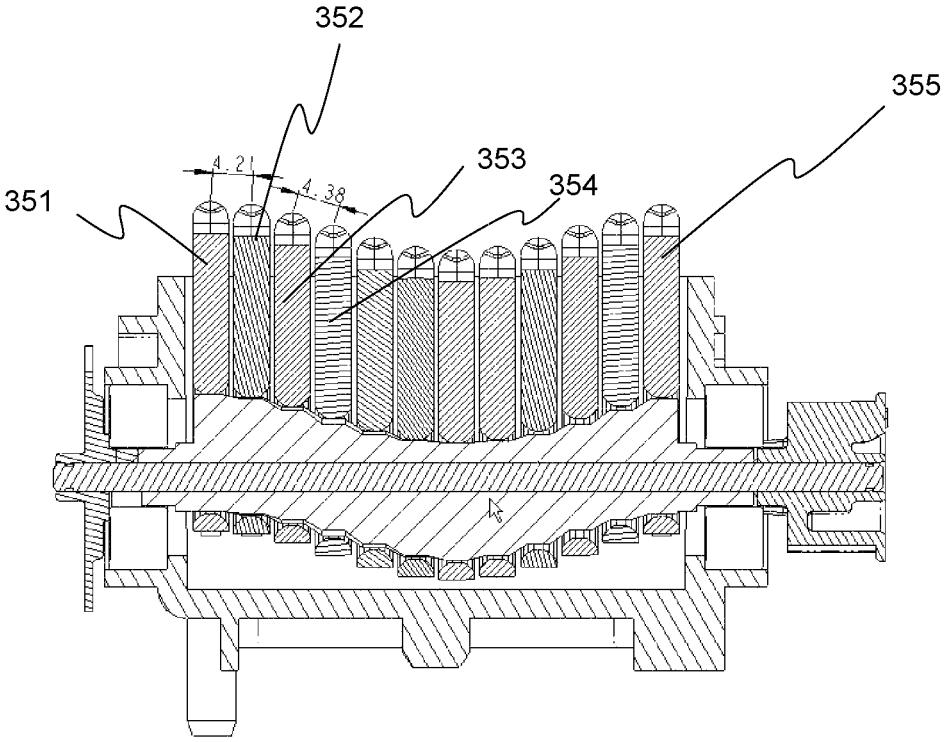

FIG. 10: sectional view of the pumping unit for a peristaltic pump showing the different distances between two successive fingers.

The object of the invention firstly comprises a membrane (110, 210) used to separate the pumping unit from the outside, particularly from the tube containing the liquid to be pumped, and additionally, the fingers (151, 152, 155, 250) that must cooperate with the membrane (110, 210). To ensure that the membrane remains in permanent contact with the fingers and thus follows their reciprocating movement, means for maintaining contact have been provided, made up of a) coupling means located on the face of the membrane facing the fingers, and b) means for cooperating with these coupling means, placed on the ends of the fingers facing the membrane.

In order to simplify the description, we will refer to the "direction of flow" or to the "plane of flow". This is the direction the tubing follows during use, and the plane parallel to this direction and to the pumping fingers. "Transverse directions" or "transverse planes" are directions or planes perpendicular to the "direction of flow or to the "plane of flow". In the description of the membrane or the fingers, these references refer to their assembled position.

The membrane of the invention (110, 210) is made up of a rigid frame (111, 211), a track (112, 212), and an intermediate membrane (113, 213). The membrane is impermeable to liquid, and serves to protect the pumping unit from intrusion by foreign objects and dust. It is placed between the pumping fingers and the tube containing the liquid to be pumped.

The frame (111, 211) is preferably made of a relatively rigid material, e.g., polyamide 6. It is equipped with fixing means (114, 214) for attaching it to the pump. These can be holes (114) for attachment screws, as in the first embodiment, or snap-in tabs (214), as in the second embodiment. On the face intended to be in contact with the tubing, the frame (111, 211) can also be equipped with means (215) for attaching said tubing.

The intermediate membrane (113, 213) is made of a very flexible material, e.g., TPE (thermoplastic elastomer). It is preferably overmolded on the frame (111, 211) and the track (112, 212). The shape of the intermediate membrane (113, 213) is chosen so that in the absence of any external stress, the track (112, 212) is in a plane offset toward the tubing relative to the plane of the frame (111, 211), as the section in FIG. 8 shows, for example. The intermediate membrane (113, 213) must be flexible enough that it offers practically no resistance to the vertical and horizontal translational motion of the track (112, 212).

The track (112, 212) is made of a material that is flexible enough to accompany the movements of the fingers (151, 152, 155, 250), while being resistant enough to not become worn from the friction of the fingers. The flexibility of the part can be obtained in two ways: either a very thin part made of a very stiff material is chosen (for example, a steel sheet with 0.1 mm thickness would do), or a thick part in a soft material or one with a low modulus of elasticity. For example, a compound in the high-density polyethylene or polyamide family can be chosen for the track. Grilamid® L 20 W 20 polyamide 12 from EMS-Chemie works very nicely. It has the following mechanical characteristics in particular:

Modulus of elasticity from tensile test (1 mm/min): 500 MPa

Tensile strength at the creep threshold (50 mm/min): 30 MPa

Tensile strain at the creep threshold (50 mm/min): 20%

Breaking load (50 mm/min): 40 MPa

Elongation at break (50 mm/min): >50%

V-notch test strength (Charpy, 23° C.): 40 kJ/$m^2$ (Charpy, −30° C.): 3 kJ/$m^2$ Shore D hardness: 65

On the track (112, 212), the membrane of the invention is equipped with coupling means to couple it to each of the fingers (151, 152, 155, 250) in the pumping unit. The objective of the invention is actually for the track to follow the movements of the fingers. In other words, the track must not only be pressed onto the tube when a finger is in the occluding position, but it must also follow the movement of the finger as it withdraws so as to not exert pressure on the tube when a finger is in the up position.

The curve defined by the ends of the fingers corresponds to a sine wave, as clearly shown in FIGS. 3 and 10. Wherever the curve is in its progress, its total length, measured between the two outer fingers (351, 355), remains constant. Therefore, the track (112, 212) does not need to be elastic; it only needs to be flexible enough to follow the sinusoidal motion of the fingers (151, 152, 155, 250). However, the distance between two successive fingers (351, 352/353, 354) changes as the reciprocating cycle progresses. It is smaller when the fingers (351, 352) are near the end points of their travel, and greater when the two fingers (353, 354) are near the center of their travel. In the example in FIG. 10, the distance between the first two fingers (351, 352) is about 4.2 mm, whereas between the third and fourth fingers (353, 354) it is about 4.4 mm. Thus if the track is not elastic, it must be able to follow the movement of the fingers (151, 152, 155, 250) by having translational mobility in a slight reciprocating movement with respect to the fingers (151, 152, 155, 250). Thus, the coupling means must not be too rigid, so they have a degree of freedom in the direction the fluid flows.

In the first embodiment shown in FIGS. 1 to 3, the coupling means (120) consist of a series of rings (121, 122) into which pins (161) placed on the ends of the fingers (151, 152, 155) can fit. The rings (121, 122) are placed on the face of the track that is on the same side as the pumping unit in the assembled position. In the example shown, they are divided into two groups, the first group placed on one lengthwise side of the track, the other being arranged on the other side. This makes it easier to fit the rings (121, 122) onto the pins (161). The pins (161) are placed substantially on the ends of the fingers (151, 152, 155), perpendicular to the plane of flow. These rings are readily visible in FIG. 3, which shows a track (112) whose rings (121, 122) are all oblong in shape. However, as FIG. 1 shows, it is preferable to have the rings on the ends (122) be practically circular, while the rings in between (121) have an oblong shape elongated in the direction of flow. This makes it possible to keep the upstream and downstream ends of the track practically fixed relative to their respective finger (151, 155) while allowing the track (112) to slide back and forth on the fingers in between (152). It can be seen in FIG. 3 that the rings for the $3^{rd}$ and $9^{th}$ fingers (starting from the left), which are in the end positions, are almost centered on their respective pins, whereas the ring for the $5^{th}$ finger, for example, is displaced rightward relative to its pin. The track thus has relative translational movement with respect to the ends of the in-between fingers (152).

In a second embodiment of the invention shown in FIGS. 4 to 9, the coupling means are made up of mushroom-shaped snap-in elements (220). These mushrooms (220) are made up of a stem (221) with a plate (222) on top. This plate (222) is proportioned and placed on the stem (221) so that shoulders (223) are formed in the transverse plane (FIG. 6*b*).

The fingers (250) intended to cooperate with these mushrooms (220) are equipped with a slot (260) at their ends. This slot (260) is arranged so that in the assembled position, the slot (260) is parallel to the plane of flow. At its opening, the slot has two shoulders (261). The width of the slot (260) is at least equal to the (transverse) width of the mushroom plate (222), and the opening between the two shoulders (261) is at least equal to the (transverse) width of the mushroom stem (221). In the assembled position shown in FIG. 8, the mushroom fits into the slot (260), with the shoulders (223) of the mushrooms (220) bearing against the shoulders (261) of the slot (260).

To facilitate snapping the mushrooms (220) into the slots (260), it is preferable to have the plate (222) pointed or rounded on the face opposite the stem (221), and to have at least one of the walls of the slot (260) made of an elastic plate that can give when the mushroom (220) is inserted.

Because of the shoulders (223, 261), the mushrooms (220) can move in the slots (260) in a movement parallel to the direction of flow perpendicular to the plane of FIG. 8. To keep the track (212) from migrating in response to the overall movement of the fingers, as the fluid in the tubing does, it is preferable to provide a retaining tab (217), to be placed between two successive fingers. It is preferable to place it in the center, as in FIG. 9.

In addition, to keep the intermediate membrane (213) from tearing at the upstream and downstream ends of the track (212), the latter can be extended in the direction of flow with two end tabs (216) so that the rigid part of the track absorbs the stresses and makes a gentler transition with the flexible part.

With the means for maintaining contact of the invention, for the part of the membrane on which the fingers press, a relatively hard material can be chosen that will not become worn from the friction of the fingers. Nevertheless, the relative rigidity of this track does not interfere with the tube when it returns to its open, cylindrical shape, as the means for maintaining contact force the track to follow the movement of the fingers as they withdraw, pulling it away from the tube.

Due to the more resistant material of the track, the membrane no longer needs to be replaced during the useful life of the pump. In this way, painstaking recalibrations can be avoided.

List of references:

| | | |
|---|---|---|
| 110 | 210 | Membrane |
| 111 | 211 | Membrane frame |
| 112 | 212 | Membrane track |
| 113 | 213 | Intermediate membrane of the membrane |
| 114 | 214 | Membrane fixing means |
| | 215 | Tube fixing means |
| | 216 | End tabs |
| | 217 | Retaining means |
| 120 | 220 | Coupling means |
| 121 | | In-between coupling ring |
| 122 | | Outer coupling ring |
| | 221 | Mushroom stem |
| | 222 | Mushroom plate |
| | 223 | Mushroom shoulder |
| | 250 | Finger |
| 151 | 351 | Outer finger |
| 152 | 352, 353, 354 | In-between fingers |
| 155 | 355 | Outer finger |
| 160 | 260 | Means cooperating with the coupling means |
| 161 | | Coupling pin |
| | 261 | Shoulder |

The invention claimed is:

1. A linear peristaltic pump comprising:

pumping fingers, a tubing which is resiliently compressible by the fingers and which allows a liquid to circulate within the tubing in a rest position of the tubing, a membrane placed between the pumping fingers and the tubing, and means for keeping a first part of the membrane on which the fingers press, called a track, in permanent contact with ends of the fingers during an entire pumping cycle, even in the absence of the tubing, wherein at least the means for keeping the track in permanent contact with the ends of fingers that have two neighboring fingers have a degree of freedom parallel to a pumping direction oriented along a flow direction of liquid in a longitudinal direction of the tubing, so that during a pumping cycle, the track can have reciprocating translational movement, substantially parallel to the pumping direction, with respect to the ends of said fingers.

2. The peristaltic pump according to claim 1, wherein the means for keeping the track in permanent contact with the ends of the fingers comprise means for mechanically coupling the track to the end of at least one finger.

3. The peristaltic pump according to claim 2, wherein the means for mechanically coupling the track and the end of at least one finger comprise (a) coupling means located on a face of the membrane facing the fingers, and (b) means for cooperating with the coupling means, placed at the end of the finger or fingers.

4. The peristaltic pump according to claim 1, which is provided with means for blocking an overall movement of the track in the pumping direction.

5. The peristaltic pump according to claim 1, wherein the track is attached to a second part of the membrane, called an intermediate membrane element, which is attached to a structure of the pump and which is more flexible than the track.

6. The peristaltic pump according to claim 5, wherein the intermediate membrane element surrounds the track.

7. The peristaltic pump according to claim 5, wherein the track is flexible, but not elastic.

8. The peristaltic pump according to claim 5, wherein the membrane comprises a rigid frame fixed to the structure of the pump, wherein the intermediate membrane element connects the track to the frame in such a way that the membrane forms a continuous, impermeable surface.

9. The peristaltic pump according to claim 2, wherein the means for mechanically coupling comprise mushroom-shaped elements engaged in slots extending in the pumping direction and placed in the end of one or more pumping fingers.

10. The peristaltic pump according to claim 2, wherein the means for mechanically coupling comprise rings placed on the track parallel to the pumping direction, into which pins on the end of one or more pumping fingers can fit.

11. A membrane for placing between pumping fingers and a tubing of a peristaltic pump, comprising a first part, called a track, where pumping fingers of the pump press during operation to move liquid in a pumping direction oriented in a flow direction of liquid in a longitudinal direction of the tubing, means for mechanically coupling the track to an end of at least one of the pumping fingers of the pump, wherein the means for mechanically coupling constitute part of means for keeping the ends of the fingers in permanent contact with the track during an entire pumping cycle when the membrane is placed in the peristaltic pump, even in the absence of the tubing, wherein the track is attached to a second part of the membrane, called an intermediate membrane element, which is for attaching the membrane to a structure of the pump and which is more flexible than the track, wherein at least the means for mechanically coupling the track to the ends of fingers that have two neighbors have a degree of freedom parallel to the pumping direction, so that during a pumping cycle, the track can have reciprocating translational movement, substantially parallel to the pumping direction, with respect to the ends of said fingers.

12. The membrane according to claim 11, wherein the membrane is provided with means for blocking an overall movement of the track in the pumping direction.

13. The membrane according to claim 12, wherein the means for blocking the track comprise a retaining tab placed between two successive means for mechanically coupling, and arranged perpendicular to the pumping direction.

14. The membrane according to claim 13, wherein the retaining tab is placed in a middle of the track.

15. The membrane according to claim 11, wherein the track is flexible, but not elastic, due to a combination of its geometry and its material.

16. The membrane according to claim 15, wherein the membrane is made of a rigid frame equipped with means for fixing the membrane inside the pump, the track, and an intermediate flexible membrane element connecting the track to the frame in such a way that the membrane forms a continuous, impermeable surface.

17. The membrane according to claim 16, wherein the intermediate membrane is proportioned so as to push the track in an opposite direction from the means for mechanically coupling in the absence of any pressure.

18. The membrane according to claim 16, wherein the intermediate membrane element is overmolded on the frame and the track.

19. The membrane according to claim 11, wherein the means for mechanically coupling comprise mushroom-shaped elements engageable in slots extending in the pumping direction and placed in the end of one or more pumping fingers.

20. The membrane according to claim 11, wherein the means for mechanically coupling comprise rings placed on the track parallel to the pumping direction, into which pins on the end of one or more pumping fingers can fit.

21. The membrane according to claim 20, wherein the rings comprise (i) an upstream end ring, (ii) a downstream end ring, and (iii) intermediate rings positioned between a position of the upstream end ring and a position of the downstream end ring along the pumping direction, wherein (a) the intermediate rings, intended to cooperate with intermediate fingers that have two neighboring fingers called upstream and downstream fingers, are oblong, with their long axis parallel to the pumping direction, and/or (b) the upstream and downstream end rings, intended to cooperate with upstream and downstream end fingers, are circular and forming blocking means for the track.

22. The membrane according to claim 11, wherein the track is extended on both sides of the means for mechanically coupling by two end tabs.

23. A method of pumping through a tubing comprising: performing a pumping movement by moving pumping fingers between a respective first position allowing circulation of a flow within the tubing in a rest position of the tubing and a respective second position resiliently compressing the tubing, providing a membrane between the pumping fingers and the tubing, and keeping a first part of the membrane on which the fingers press, called a track, in permanent contact with ends of the fingers during an entire pumping cycle, wherein the track is kept in permanent contact with the ends of intermediate fingers that have two neighboring fingers, wherein a degree of freedom in a pumping direction, parallel to a flow direction in the tubing during the pumping cycle, is maintained between the track and respective ends of the pumping fingers, so that during a pumping cycle, the track can have reciprocating translational movement, substantially parallel to the pumping direction, with respect to the ends of said intermediate fingers.

24. The method according to claim 23, wherein the track is kept in permanent contact with the ends of the fingers by mechanically coupling the track to the end of at least one finger.

25. The method according to claim 23, wherein an overall movement of the track is blocked in the pumping direction.

26. The method according to claim 24, wherein the track comprises mushroom-shaped elements engaged in slots extending in the pumping direction and placed in the end of one or more pumping fingers.

27. A membrane for placing between pumping fingers and a tubing of a peristaltic pump, comprising a first part, called a track, where pumping fingers of the pump press during operation to move liquid in a pumping direction oriented in a flow direction of liquid in a longitudinal direction of the tubing, means for mechanically coupling the track to an end of at least one of the pumping fingers of the pump, wherein the means for mechanically coupling constitute part of means for keeping the ends of the fingers in permanent contact with the track during an entire pumping cycle when the membrane is placed in the peristaltic pump, even in the absence of the tubing, wherein the track is attached to a second part of the membrane, called an intermediate membrane element, which is for attaching the membrane to a structure of the pump and which is more flexible than the track, wherein the means for mechanically coupling comprise mushroom-shaped elements engageable in slots extending in the pumping direction and placed in the end of one or more pumping fingers.

* * * * *